US005986528A

United States Patent [19]

Meier et al.

[11] Patent Number: 5,986,528

[45] Date of Patent: Nov. 16, 1999

[54] ELECTRICAL SWITCHING DEVICE

[75] Inventors: Markus Meier, Rieden; Bardo Koppmann, Kaltenbrunn, both of Germany

[73] Assignee: Siemens Aktiengesellschaft, Munich, Germany

[21] Appl. No.: 09/101,868

[22] PCT Filed: Jan. 9, 1997

[86] PCT No.: PCT/DE97/00023

§ 371 Date: Jul. 21, 1998

§ 102(e) Date: Jul. 21, 1998

[87] PCT Pub. No.: WO97/27602

PCT Pub. Date: Jul. 31, 1997

[30] Foreign Application Priority Data

Jan. 22, 1996 [DE] Germany ..... 196 02 118

[51] Int. Cl.[6] ..... H01H 75/00

[52] U.S. Cl. ..... 335/6; 335/15; 335/16; 335/132; 335/172; 335/177; 335/178; 335/129; 335/180; 335/182; 335/183; 335/184; 335/194; 335/195; 335/266

[58] Field of Search ..... 335/6, 12, 15, 335/16, 18, 132, 147, 172, 177, 178, 129, 180, 182, 183, 184, 194, 195, 258, 266

[56] References Cited

U.S. PATENT DOCUMENTS

| | | | |
|---|---|---|---|
| 3,465,270 | 9/1969 | Schattler | 335/78 |
| 3,921,109 | 11/1975 | Hodgson | 335/195 |
| 3,991,290 | 11/1976 | Bayles et al. | 200/250 |
| 4,292,611 | 9/1981 | Bresson et al. | 335/6 |
| 4,307,358 | 12/1981 | Haury et al. | 335/6 |
| 4,491,812 | 1/1985 | Happach | 335/184 |
| 5,163,175 | 11/1992 | Mori et al. | 335/132 |

FOREIGN PATENT DOCUMENTS

| | | | |
|---|---|---|---|
| 28 48 287 | 5/1979 | Germany | 335/6 |
| 41 04 533 | 8/1991 | Germany | 335/132 |

*Primary Examiner*—Lincoln Donovan
*Assistant Examiner*—Raymond Barrera
*Attorney, Agent, or Firm*—Kenyon & Kenyon

[57] ABSTRACT

An electrical switching device prevents moving contacts from welding to stationary contacts in a switching device. This is achieved using an auxiliary magnet system in the main current path, which system produces a contact pressure force corresponding to the excitation current so that no arcs are produce between the contacts when overcurrents and short-circuit currents occur. The moving iron core of the auxiliary magnet system is for this purpose connected to the contact link mounting via which the contacts are switched on and off.

6 Claims, 3 Drawing Sheets

ELECTRICAL SWITCHING DEVICE

FIELD OF THE INVENTION

The present invention relates to an electrical switching device having a moving contact element with a pair of moving contacts on the moving contact element, a pair of stationary contact elements to which the stationary contacts are individually attached, a first electromagnetic drive apparatus having a stationary iron core, a moving iron core and a coil which is electrically connected in series with one of the stationary contacts, and a second electromagnetic drive apparatus which comprises a yoke, an armature and a winding, for switching on and off the load current via a transmission member.

BACKGROUND INFORMATION

German Patent Application No. 41 04 533 describes a conventional switching device. Here, an n-release is provided as an auxiliary magnet system to whose armature a plunger is attached, which plunger is used to strike the contacts when overcurrents occur. This is intended to prevent the contacts from welding as a consequence of overcurrents and, when such overcurrents occur, the contacts are disconnected to a greater or lesser extent, depending on the current, with arcs being formed. The plunger is guided in the cylindrical cavity of a contact link mounting which is of tubular design and can be operated via a lever by a main magnet system in order to switch the load current on and off. In this case, the auxiliary magnet system is located underneath the contact arrangement in such a manner that the line of the plunger axis is aligned with the longitudinal center axis of the contact link mounting. The main magnet system is arranged alongside the auxiliary magnet system, i.e., laterally offset from the longitudinal center axis of the contact link mounting.

German Patent Application No: 28 48 287 describes a solenoid switch in which the contacts are opened rapidly in order to switch the load circuit on and off when overcurrents occur. The solenoid switch is an apparatus that is sensitive to overcurrents. The solenoid switch includes a winding through which the load current flows. The solenoid switch further includes a magnet core which is provided with a striking pin. An electromagnet switches the load current via the contacts on and off, for which purpose its armature is coupled via a magnetic force store to a transmission device which can move longitudinally, in consequence carries out a movement in the longitudinal direction when the electromagnet is excited and, in the process, lifts the moving contacts, which are attached to a moving contact link of the stationary contacts. When overcurrents occur, the armature of the solenoid switch acts on the spring force store in such a manner that the latter accelerates the transmission device suddenly and pulls the contacts apart in order to avoid welding. The force from the electromagnet can also be transmitted by a push rod which is guided in a transmission device operated by the solenoid switch.

SUMMARY OF THE INVENTION

An object of the present invention is to provide an improved switching device within which welding of the contacts is precluded by avoiding arcs that are dependent on overcurrents.

The object is achieved according to the present invention in that the transmission member is designed as a contact link mounting with a window in which the moving contact element is held, in that the contact link mounting is coupled to the armature without any levers being interposed, in that the moving iron core of the first drive apparatus is attached to the contact link mounting, and in that the moving iron core is acted on by a force which is proportional to the load current and holds the contacts via the contact link mounting.

An advantageous development of the present invention results if the first drive apparatus and the second drive apparatus are arranged coaxially with respect to one another and have a common line of force action which is aligned with the axis of symmetry of the contact link mounting. This has the advantage that only longitudinal forces act and the forces can be completely brought into effect while minimizing losses, that is to say, for example, friction losses (as normally occur when deflection levers are used) are reduced.

If the contact link mounting comprises two parts which can move in one direction relative to one another, then this allows the contact link mounting to be shortened, when the magnetic circuit of the second drive apparatus is closed owing to the action of the force of the first drive apparatus, in such a manner that the contact pressure of the moving contacts on the stationary contacts is increased.

The parts of the contact mounting include a contact mounting plate, which is attached to the armature of the second drive apparatus, and a contact mounting dome which is coupled to the contact mounting plate via a spring. The previously described shortening of the contact link mounting is easily achieved in this way.

Furthermore, it has been found to be advantageous for the contact mounting dome to be provided with the window in which the moving contact element is prestressed by a contact spring in the direction of the stationary contacts, and for a pressure piece to be provided which limits the spring travel by which the spring can be shortened on compression. This configuration results in the additional force of the first drive apparatus acting directly on the stationary contacts, via the contact mounting dome and the pressure piece in order to compress the moving contact, when overcurrents occur. Thus, in this case, the governing factor is no longer the action of the force of the contact spring as when the first drive apparatus is used for switching on.

A further advantageous solution results if the contact link mounting and the moving iron core can be moved with respect to one another in the movement direction and if the moving iron core is provided with a plunger which is guided by the contour of the contact link mounting and pulls apart, the contacts via the contact element, when overcurrents occur. This configuration can be implemented in a simple manner and means a modification of the solution concept described above. While, in the case of this solution concept, freedom from welding is achieved by dynamically increasing the contact force, the freedom from welding in the present solution is accomplished by striking the moving contact element.

DETAILED DESCRIPTION OF THE INVENTION

Figure 1:
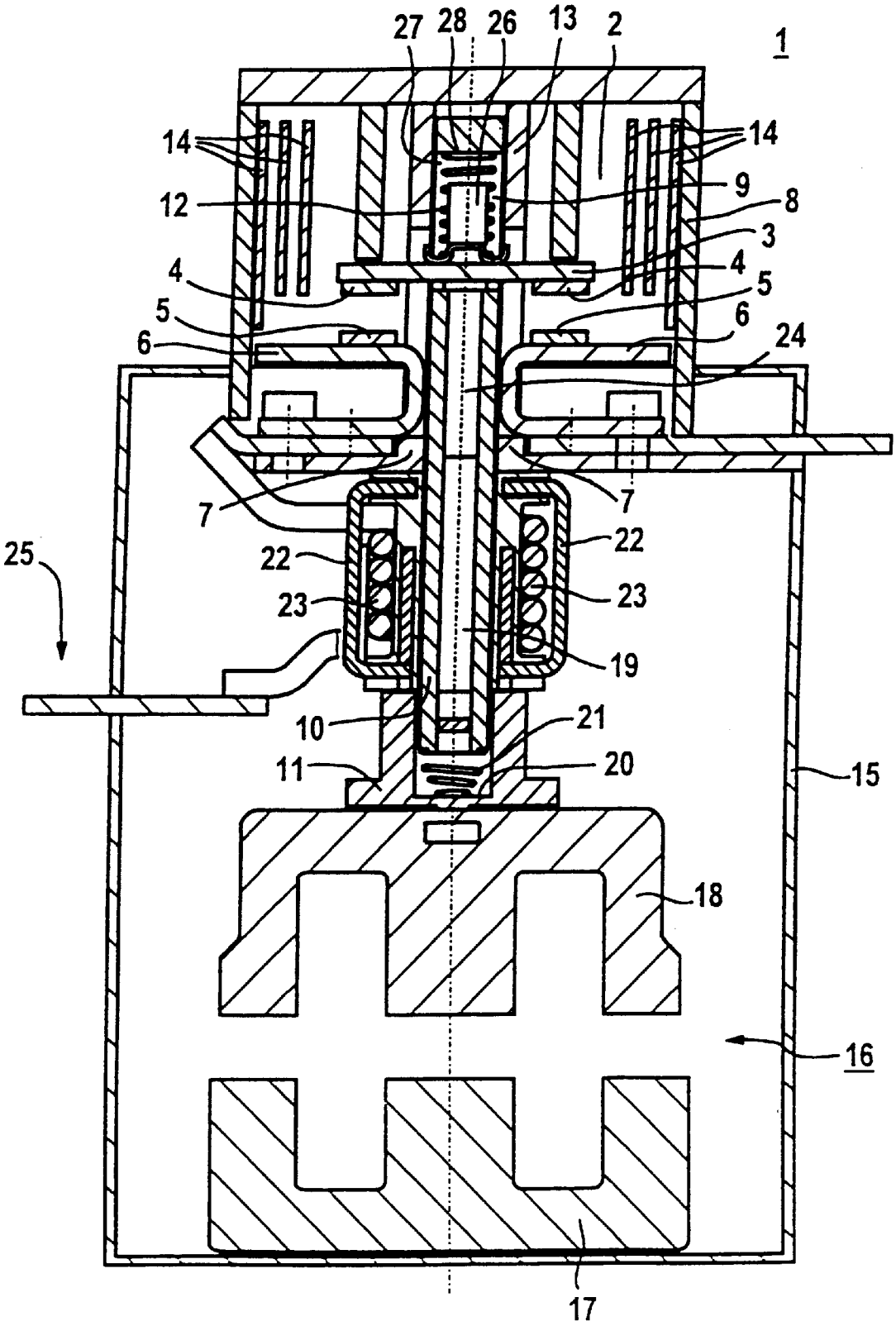
FIG. 1 shows an electrical switching device in which freedom from welding is provided bay dynamically increasing a contact force in an OFF state.

FIG. 1 shows a first exemplary embodiment of an electrical switching device 1 having a contact device 3, 4, 5 in an arc chamber 2, a main magnet system 16 which operates the contact device 3, 4, 5, and an auxiliary magnet system 22, 23, 24 which is arranged between the contact device 3, 4, 5 and the main magnet system 16. The main magnet system 16 and the auxiliary magnet system 22, 23, 24 are designed as electromagnetic drive apparatuses. The auxiliary magnet system 22, 23, 24 is advantageously arranged on the line in which the force of the main magnet system 16 acts so that, in contrast to the previous technique which operates with deflection levers, both magnet systems exert their effect without any delay and without any deflection levers being interposed. Dispensing with deflection levers also means a reduction in the number of components, which is usually desirable. FIG. 1 shows the system for one phase; the design for the other phases is essentially the same, so that the description for this one phase also applies to the other phases.

The contact device 3, 4, 5 comprises a moving contact link 3 as the moving contact element, in each case having a moving contact 4 on mutually opposite end regions of the contact link 3. The moving contacts 4 are arranged opposite a pair of stationary contacts 5. The stationary contacts 5 are in each case connected to a contact element 6 which is attached to a housing step 7 in the interior of an upper housing half 8.

The contact link 3 is pushed into a window 9 in a contact link mounting which is in the form of a rod, is designed in two parts and comprises a contact mounting dome 10 and a contact mounting plate 11. In FIG. 1, the contact mounting dome 10 is held up via a spiral spring 12 as the main contact spring, the contact mounting dome 10 and the contact link 3 being prestressed downward by the spiral spring 12, in a guide 13 in FIG. 1. A pair of arc quenching plates 14 which are arranged in groups and are composed of a magnetic, metallic material are provided on mutually opposite sides of the contact link 3 in order to quench the arcs which are struck when the contact between the moving contacts 4 and the stationary contacts 5 is broken.

The auxiliary magnet system comprises a stationary iron core (which is formed by two U-shaped iron plates 22), a coil 23 and an armature 24 as a moving iron core.

According to FIG. 1, the main magnet system 16, which is used as an operating and actuating mechanism, is located in a lower housing half 15. It is designed as an electromagnet which comprises a stationary iron core 17, a moving armature 18 as well as a coil or winding (which is not illustrated here) and on which current can act in order to operate the switching device via a control circuit.

Figure 2:
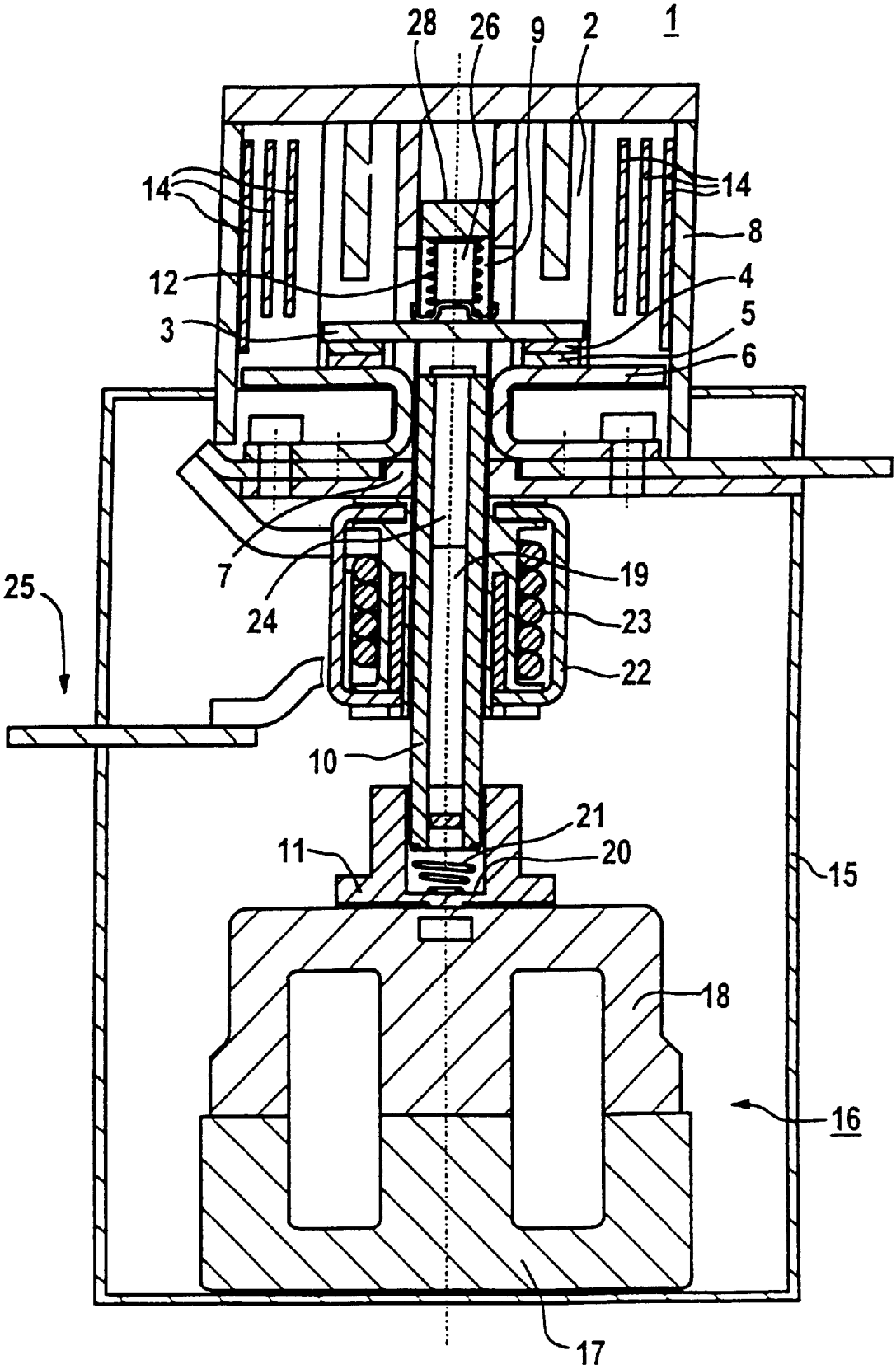
FIG. 2 shows the electrical switching device according to FIG. 1 in an ON state.

FIG. 2 shows the switching device 1 according to the present invention in the switched-on state, i.e., when carrying current. The operation of the switching device 1 will be explained below with reference to FIGS. 1 and 2.

When the main magnet system 16 is actuated, the armature 18 illustrated FIGS. 1 and 2 moves downward and assumes the position according to FIG. 2. During this downward movement, the contact link mounting 10, 11 is driven downward as a result of the coupling, the contact spring 12 being compressed (once the moving contacts 4 have come into contact with the stationary contacts 5) virtually by the spring travel, which corresponds to the air gap 27 when the switching device 1 is in the state with no current flowing, according to FIG. 2.

The problem that arises is that, as the load current rises, the forces which try to drive the contacts 4, 5 apart from one another increase. The pulling apart of the contacts 4, 5 results, as undesirable side effects, in the formation of arcs, the increase in the temperature of the contacts 4, 5 linked to this, and possible welding of the contacts 4, 5. However, as the load current in the main current path rises, this problem is solved in the case of the present switching device 1 by increasing the force on the contact point from the auxiliary magnet system 22, 23, 24. This is achieved via the armature 24 of the auxiliary magnet system, on which armature 24 a force is exerted, according to FIG. 1, in the direction of the main magnet system 16, together with the contact mounting dome 10. In this case, the contact mounting dome 10 forces the contact link 3 directly downward via the pressure piece 26, since the contact spring 12—as mentioned above—is already compressed virtually by the air gap 27. This has the consequence that the additional force of the auxiliary magnet system 22, 23, 24 produced when overcurrents occur is transmitted directly to the contact point between the moving contacts 4 and the stationary contacts 5 while, otherwise, when normal load currents are flowing, only the considerably smaller contact force from the contact spring 12 acts. In order that the described additional force of the auxiliary magnet system 22, 23, 24 can come into effect completely, the contact mounting dome 10 can be moved relative to the contact mounting plate 11, with the spring 21 being interposed.

Contrary to the exemplary embodiment illustrated in FIG. 1, the pressure piece 26 could also be integrally formed on the upper edge surface 28 of the window 9 in the contact mounting dome 10 and, accordingly, the spiral spring 12 could project by the air gap 27 described above at the lower end of the pressure piece 26, without this changing the principle of the method of operation.

Figure 3:
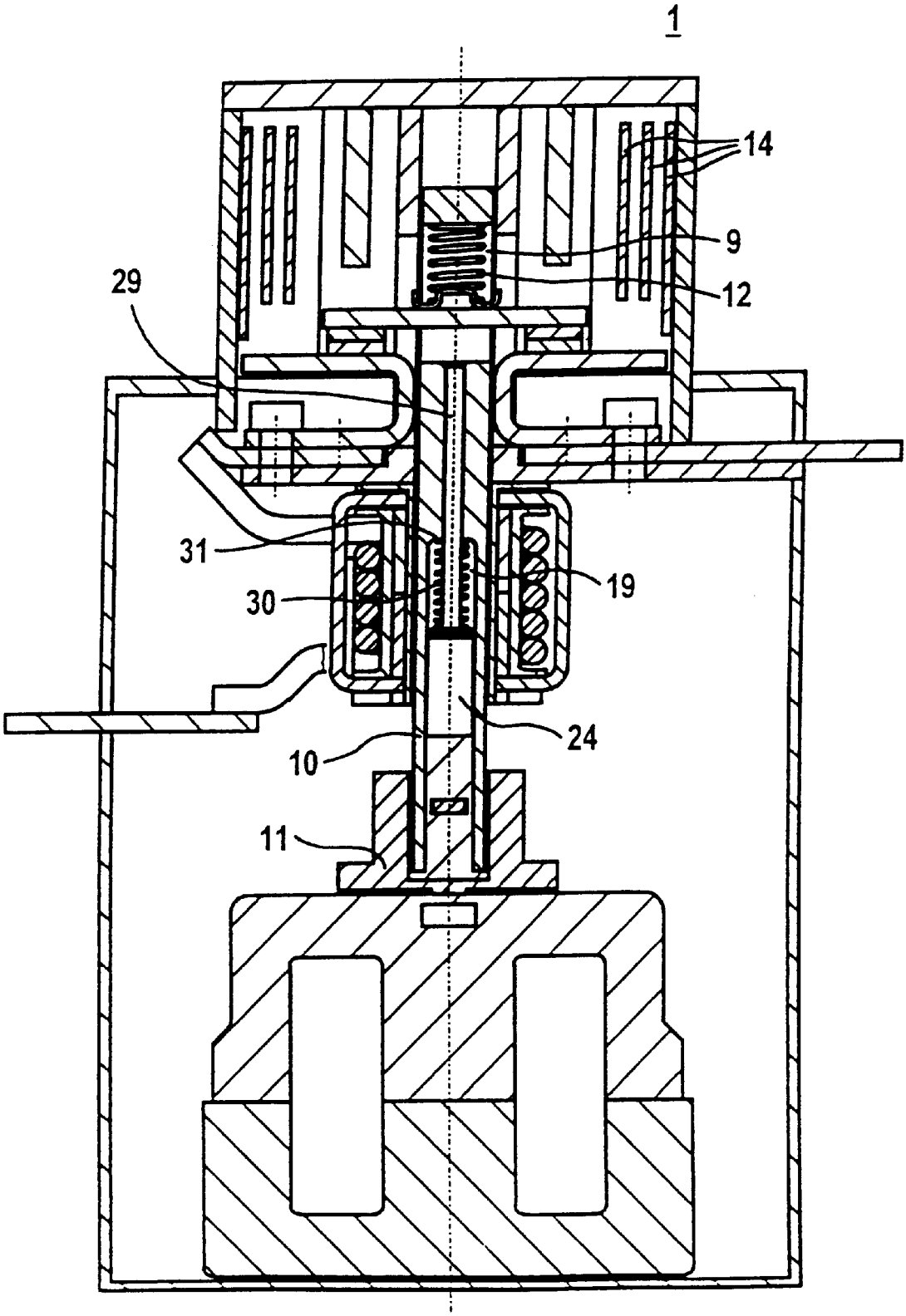
FIG. 3 shows an electrical switching device where freedom from welding is providing by striking a contact link.

FIG. 3 shows a second exemplary embodiment of a switching device 1 in the switched-on state. This largely corresponds to the first exemplary embodiment of the switching device 1 according to FIGS. 1 and 2.

The modification in the second exemplary embodiment relates to the design of the contact link mounting. In this case, the contact link mounting comprises a contact mounting plate 11 and a tubular contact mounting dome 10 with a window 9 for holding the contact spring 12. However, there is no pressure piece and the contact mounting dome 10 and the contact mounting plate 11 are permanently connected to one another, for example, by a screw connection, bonding or welding. The armature 24 of the auxiliary magnet system is mounted in a moving manner in the cylindrical cavity 19 in the contact mounting dome 10 and is provided at its upper end with a plunger 29 or striking pin which, in the event of tripping as a result of an overcurrent or short-circuit current, can be moved into the window 9. Located around the plunger 29 is a restoring compression spring 30 which is supported at one end on a step 31 in the cylindrical cavity 19 and at the other end acts on the armature 24.

In the case of the solution according to the second exemplary embodiment, the desired freedom from welding is achieved by striking the moving contact link 3 in the event of an overcurrent or short circuit. The function of the plunger 29 corresponds to this, the plunger 29 being accelerated in the direction of the contact link 3, as a consequence of overcurrents, by the action of the force of the auxiliary magnet system 22, 23, 24 together with the armature 24, and striking the contact link 3 upward, so that the contacts 4, 5 are pulled apart. At the same time, the restoring compression spring 30 is compressed. Depending on the strength of the restoring compression spring 30, the onset of the striking effect of the plunger 29 can be varied as required.

The arcs which occur when the contacts 4, 5 are pulled apart during normal disconnection of load currents by the main magnet system 16 are struck and cooled by the arc quenching plates 14 and, as a result of this, are quenched at the alternating current zero crossing.

When overcurrents occur, the contacts 4, 5 are pulled apart via the plunger 29 of the auxiliary magnet system 22, 23, 24, likewise with the consequence that arcs are once again struck. These arcs are struck by the arc quenching plates 14, so that the arc resistance increases and, as a consequence of this, the short-circuit current is limited. The short-circuit current is then interrupted by an interrupter or disconnector switch that is not illustrated.

What is claimed is:

1. An electrical switching device, comprising:

a moving contact element;

moving contacts positioned on the moving contact element;

stationary contacts;

stationary contact elements, each of the stationary contacts elements individually coupled to one of the stationary contacts;

a first electromagnetic drive apparatus including a stationary iron core, a moving iron core and a coil, the coil being electrically coupled in series to one of the stationary contacts; and a second electromagnetic drive apparatus including a yoke magnet, an armature and a winding, the second electromagnetic drive apparatus for switching a load current between one of an on state and an off state using a transmission member, the transmission member including a contact link mounting having a window, the window holding the moving contact element, the contact link mounting being coupled to the armature without a lever being interposed therebetween, the moving iron core being coupled to the contact link mounting, the moving iron core being acted on by a force, the force being proportional to a current load flowing in the coil and the moving iron core holding together the moving contacts and the stationary contacts using the contact link mounting.

2. The electrical switching device according to claim 1, wherein the first electromagnetic drive apparatus is arranged coaxially with respect to the second electromagnetic drive apparatus, the first electromagnetic drive apparatus and the second electromagnetic drive apparatus having a common line of force action aligned with an symmetry axis of the contact link mounting.

3. The electrical switching device according to claim 1, wherein the contact link mounting includes a first part and a second part, one of the first part and the second part capable of moving relative to the other one of the first part and the second part.

4. The electrical switching device according to claim 3, wherein the first part includes a contact mounting plate coupled to the armature and wherein the second part includes a contact mounting dome, the contact mounting dome being coupled to the contact mounting plate using a spring.

5. The electrical switching device according to claim 1, further comprising:

a contact mounting dome including the window, the moving contact element being prestressed in the window in a direction of the stationary contacts using a contact spring; and a pressure piece limiting a spring travel, the contact spring being shortened on compression using the pressure piece.

6. An electrical switching device, comprising:

a moving contact element;

moving contacts positioned on the moving contact element;

stationary contacts;

stationary contact elements, each of the plurality of stationary contacts elements being individually coupled to one of the stationary contacts;

a first electromagnetic drive apparatus including a stationary iron core, a moving iron core and a coil, the coil being electrically coupled in series to one of the stationary contacts; and a second electromagnetic drive apparatus including a yoke magnet, an armature and a winding, the second electromagnetic drive apparatus switching a load current between one of an on state and an off state using a transmission member, the transmission member including a contact link mounting having a window, the window holding the moving contact element, the contact link mounting being coupled to the armature without a lever being interposed therebetween, the moving iron core being movable with respect to the contact link mounting, the moving iron core including a plunger guided by a contour of the contact link mounting, the plunger pulling apart the moving contacts from the stationary contacts when the current load is greater than a predetermined current load.

* * * * *